United States Patent [19]

Machonkin et al.

[11] Patent Number: 4,975,354

[45] Date of Patent: Dec. 4, 1990

[54] PHOTOGRAPHIC ELEMENT COMPRISING AN ETHYLENEOXY-SUBSTITUTED AMINO COMPOUND AND PROCESS ADAPTED TO PROVIDE HIGH CONSTRAST DEVELOPMENT

[75] Inventors: Harold I. Machonkin, Webster; Donald L. Kerr, Rochester, both of N.Y.

[73] Assignee: Eastman Kodak Company, Rochester, N.Y.

[21] Appl. No.: 359,009

[22] Filed: May 30, 1989

Related U.S. Application Data

[63] Continuation-in-part of Ser. No. 255,881, Oct. 11, 1988, abandoned.

[51] Int. Cl.[5] ..... G03C 1/06; G03C 5/24

[52] U.S. Cl. ..... 430/264; 430/415; 430/434; 430/436; 430/438; 430/637; 430/949

[58] Field of Search ..... 430/264, 415, 434, 436, 430/438, 637, 949

[56] References Cited

U.S. PATENT DOCUMENTS

| | | | |
|---|---|---|---|
| 3,518,085 | 6/1970 | Milton et al. | 430/264 |
| 3,523,796 | 8/1970 | Willems et al. | 430/629 |
| 3,523,797 | 8/1970 | Willems et al. | 430/629 |
| 4,221,857 | 9/1980 | Okutsa et al. | 430/264 |
| 4,269,929 | 5/1981 | Nothnagle | 430/264 |
| 4,272,616 | 6/1981 | Kishimoto | 430/637 |
| 4,624,913 | 11/1986 | Miyasaka et al. | 430/949 |
| 4,668,605 | 5/1987 | Okutsu et al. | 430/267 |
| 4,740,452 | 4/1988 | Okutsu et al. | 430/439 |
| 4,756,990 | 7/1988 | Ooms et al. | 430/438 |
| 4,756,997 | 7/1988 | Marchesano | 430/264 |
| 4,786,587 | 11/1988 | Kuwabara | 430/264 |
| 4,863,830 | 9/1989 | Okutsu et al. | 430/264 |

FOREIGN PATENT DOCUMENTS

| | | | |
|---|---|---|---|
| 2205115 | 2/1972 | Fed. Rep. of Germany | 430/456 |
| 60-140340 | 7/1985 | Japan . | |
| 62-211647 | 9/1987 | Japan . | |
| 62-222241 | 9/1987 | Japan . | |

*Primary Examiner*—Paul R. Michl
*Assistant Examiner*—Patrick A. Doody
*Attorney, Agent, or Firm*—Alfred P. Lorenzo

[57] ABSTRACT

Silver halide photographic elements which are capable of high contrast development, when processed in the presence of a hydrazine compound that functions as a nucleating agent, include certain secondary or tertiary amino compounds which function as incorporated boosters. Such elements are particularly useful in the field of graphic arts.

49 Claims, No Drawings

PHOTOGRAPHIC ELEMENT COMPRISING AN ETHYLENEOXY-SUBSTITUTED AMINO COMPOUND AND PROCESS ADAPTED TO PROVIDE HIGH CONSTRAST DEVELOPMENT

CROSS-REFERENCE TO RELATED APPLICATIONS

This is a continuation-in-part of application Ser. No. 255,881 filed Oct. 11, 1988 and now abandoned.

FIELD OF THE INVENTION

This invention relates in general to photography and in particular to novel black-and-white photographic elements. More specifically, this invention relates to novel silver halide photographic elements, such as lithographic films used in the field of graphic arts, which are capable of high contrast development and to an improved process for the development of such elements.

BACKGROUND OF THE INVENTION

High contrast development of lithographic films has been carried out for many years using special developers which are known in the art as "lith" developers. In conventional "lith" developers, high contrast is achieved using the "lith effect" (also referred to as infectious development) as described by J. A. C. Yule in the Journal of the Franklin Institute, Vol. 239, 221–230, (1945). This type of development is believed to proceed autocatalytically. To achieve "lith effect" development, a low, but critical, concentration of free sulfite ion is maintained by use of an aldehyde bisulfite adduct, such as sodium formaldehyde bisulfite, which, in effect, acts as a sulfite ion buffer. The low sulfite ion concentration is necessary to avoid interference with the accumulation of developing agent oxidation products, since such interference can result in prevention of infectious development. The developer typically contains only a single type of developing agent, namely, a developing agent of the dihydroxybenzene type, such as hydroquinone.

Conventional "lith" developers suffer from serious deficiencies which restrict their usefulness. For example, the developer exhibits low capacity as a result of the fact that it contains hydroquinone as the sole developing agent. Also, the aldehyde tends to react with the hydroquinone to cause undesirable changes in development activity. Furthermore, the low sulfite ion concentration is inadequate to provide effective protection against aerial oxidation. As a result, a conventional "lith" developer is lacking in stability and tends to give erratic results depending on the length of time that it has been exposed to the air.

An alternative to the use of conventional "lith" developers is disclosed in Nothnagle, U.S. Pat. No. 4,269,929, "High Contrast Development Of Photographic Elements", issued May 26, 1981, the disclosure of which is incorporated herein by reference. As described in this patent, high contrast development of photographic elements is carried out in the presence of a hydrazine compound with an aqueous alkaline developing solution which has a pH of about 10 and below 12 and contains a dihydroxybenzene developing agent, a 3-pyrazolidone developing agent, a sulfite preservative, and a contrast-promoting amount of an amino compound. The developing solution combines the advantages of high capacity, a high degree of stability, and a long effective life, while providing excellent contrast and speed characteristics.

In this art, the hydrazine compounds are typically referred to as "nucleators" or "nucleating agents" and the amino compounds which function to enhance contrast are referred to as "boosters".

U.S. Pat. No. 4,269,929 describes the use of a very wide variety of amino compounds as contrast-promoting agents. In particular, it discloses the use of both inorganic amines, such as the hydroxylamines, and organic amines, including aliphatic amines, aromatic amines, cyclic amines, mixed aliphatic-aromatic amines, and heterocyclic amines. Primary, secondary and tertiary amines, as well as quaternary ammonium compounds, are included within the broad scope of the disclosure.

While the invention of U.S. Pat. No. 4,269,929 represents a very important advance in the art, its commercial utilization has been hindered by the disadvantageous characteristics exhibited by many amino compounds. Thus, for example, some amines suffer from the problem of toxicity, some from the problem of excessive volatility, some are characterized by highly unpleasant odors, some tend to form azeotropes with water, some exhibit an inadequate degree of solubility in an aqueous alkaline photographic developing solution, and some are costly yet must be used at a relatively high concentration such that they constitute a substantial portion of the total cost of the developing solution. Moreover, many amines exhibit a degree of activity as contrast-promoters in the method and composition of U.S. Pat. No. 4,269,929 that is less than is desired for commercial operation.

High contrast developing compositions which contain amino compounds as "boosters" and are intended for carrying out development in the presence of a hydrazine compound are also disclosed in U.S. Pat. Nos. 4,668,605 issued May 26, 1987 and 4,740,452 issued Apr. 26, 1988 and in Japanese Patent Publication No. 211647/87 published Sept. 17, 1987. U.S. Pat. No. 4,668,605 describes developing compositions containing a dihydroxybenzene, a p-aminophenol, a sulfite, a contrast-promoting amount of an alkanolamine comprising an hydroxyalkyl group of 2 to 10 carbon atoms, and a mercapto compound. The developing compositions of U.S. Pat. No. 4,740,452 contain a contrast-promoting amount of certain trialkyl amines, monoalkyl-dialkanolamines or dialkylmonoalkanol amines. The developing compositions of Japanese Patent Publication No. 211647/87 contain a dihydroxybenzene developing agent, a sulfite and certain amino compounds characterized by reference to their partition coefficient values. However, the developing compositions of U.S. Pat. Nos. 4,668,605 and 4,740,452 and Japanese Patent Publication No. 211647/87 do not fully meet the needs of this art, as they exhibit many disadvantageous characteristics. These include the need to use the contrast-promoting agent in such large amounts as to add greatly to the cost of the process and the many difficult problems that stem from the volatility and odor-generating characteristics of amino compounds that are effective to enhance contrast.

The inherent disadvantages of incorporating amino compounds as "boosters" in developing compositions have been recognized in the prior art, and proposals have been made heretofore to overcome the problems by incorporating the amino compound in the photographic element. In particular, the use of amino compounds as "incorporated boosters" has been proposed in Japanese Patent Publication No. 140340/85 published July 25, 1985 and in Japanese Patent Publication No. 222241/87 published Sept. 30, 1987. In Publication No. 140340/85, it is alleged that any amino compound can be utilized as an "incorporated booster", while Publication No. 222241/87 is directed to use as "incorporated boosters" of amino compounds defined by a specific structural formula. Publication No. 222241/87 points to some of the problems involved in following the teachings of Publication No. 140340/85 including problems relating to leaching of the amino compounds from the element during development and the generation of "pepper fog".

A photographic system depending on the conjoint action of hydrazine compounds which function as "nucleators" and amino compounds which function as "boosters" is an exceedingly complex system. It is influenced by both the composition and concentration of the "nucleator" and the "booster" and by many other factors including the pH and composition of the developer and the time and temperature of development. The goals of such a system include the provision of enhanced speed and contrast, together with excellent dot quality and low pepper fog. It is also desired that the amino compounds utilized be easy to synthesize, low in cost, and effective at very low concentrations. The prior art proposals for the use of amino compounds as "boosters" have failed to meet many of these objectives, and this has seriously hindered the commercial utilization of the system.

It is toward the objective of providing improved methods and elements utilizing certain amino compounds as "incorporated boosters", which overcome many of the disadvantageous features of the prior art, that the present invention is directed.

SUMMARY OF THE INVENTION

The present invention provides novel silver halide photographic elements which contain, in at least one layer of the element, certain amino compounds which are highly advantageous as "incorporated boosters". These elements are developed in the presence of a hydrazine compound which functions as a "nucleator", the hydrazine compound preferably also being incorporated in one or more layers of the photographic element.

Amino compounds utilized as "incorporated boosters" in accordance with this invention are amino compounds which:

(1) comprise at least one secondary or tertiary amino group;

(2) contain within their structure a group comprised of at least three repeating ethyleneoxy units, and (3) have a partition coefficient, as hereinafter defined, of at least one, preferably at least three, and most preferably at least four.

Included within the scope of the amino compounds utilized in this invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as "incorporated boosters" are compounds of at least 20 carbon atoms.

Preferred amino compounds for the purposes of this invention are bis-tertiary-amines which have a partition coefficient of at least three and a structure represented by the formula:

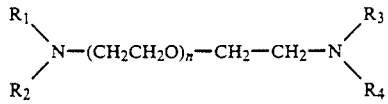

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for the purposes of this invention are bis-secondary amines which have a partition coefficient of at least three and a structure represented by the formula:

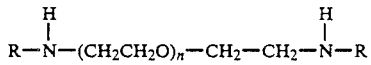

wherein n is an integer with a value of 3 to 50, and more preferably 10 to 50, and each R is, independently, a linear or branched, substituted or unsubstituted, alkyl group of at least 4 carbon atoms.

The invention also includes within its scope the method of high contrast development in which a photographic element containing, as an "incorporated booster", an amino compound, as hereinabove defined, is developed in the presence of a hydrazine compound, that functions as a "nucleator", with an aqueous alkaline photographic developing composition.

DESCRIPTION OF THE PREFERRED EMBODIMENTS

Development of the novel photographic elements of this invention is carried out in the presence of a hydrazine compound. To achieve the benefits of the invention, the hydrazine compound can be incorporated in the photographic element or in the developing solution, the essential requirement being that it be present during development of the exposed element. Incorporation of a hydrazine compound in both the photographic element and in the developing solution is, of course, a further alternative that can be utilized where it is desired to do so.

As used herein, the term "a hydrazine compound" is intended to include hydrazine and hydrazine derivatives, including those which are suited for incorporation in developing solutions and those which are suited for incorporation in photographic elements.

Any hydrazine compound that functions as a "nucleator" and is capable of acting conjointly with the "incorporated booster" of this invention to provide high contrast, can be used in the practice of this invention. The contrast or "gamma" of a photographic element refers to the rate of change of density with exposure and is measured by the slope of the straight line portion of the characteristic curve. The photographic elements of this invention typically exhibit very high contrast, by which is meant a gamma of greater than 10.

Hydrazine ($H_2N—NH_2$) is an effective contrast-promoting agent which can be incorporated in the developing solution in carrying out the method of this invention. As an alternative to the use of hydrazine, any of a wide variety of water-soluble hydrazine derivatives can be added to the developing solution. Preferred hydrazine derivatives for use in the developing solution include organic hydrazine compounds of the formula:

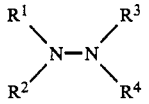

where $R^1$ is an organic radical and each of $R^2$, $R^3$ and $R^4$ is a hydrogen atom or an organic radical. Organic radicals represented by $R^1$, $R^2$, $R^3$ and $R^4$ include hydrocarbyl groups such as an alkyl group, an aryl group, an aralkyl group, an alkaryl group, and an alicyclic group, as well as hydrocarbyl groups substituted with substituents such as alkoxy groups, carboxy groups, sulfonamido groups, and halogen atoms.

Particularly preferred hydrazine derivatives for incorporation in the developing solution include alkylsulfonamido aryl hydrazines such as p-(methylsulfonamido)phenylhydrazine and alkylsulfonamidoalkyl aryl hydrazines such as p-(methylsulfonamidomethyl)-phenylhydrazine.

In the practice of this invention, it is preferred that the hydrazine compound be incorporated in the photographic element. For example, it can be incorporated in a silver halide emulsion used in forming the photographic element. Alternatively, the hydrazine compound can be present in a hydrophilic colloid layer of the photographic element, preferably a hydrophilic colloid layer which is coated to be contiguously adjacent to the emulsion layer in which the effects of the hydrazine compound are desired. It can, of course, be present in the photographic element distributed between or among emulsion and hydrophilic colloid layers, such as undercoating layers, interlayers and overcoating layers.

Photographic elements which are particularly preferred for use in the method of this invention include elements containing a hydrazine compound of the formula:

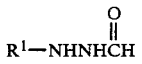

wherein $R^1$ is a phenyl nucleus having a Hammett sigma value-derived electron withdrawing characteristic of less than +0.30.

In the above formula, $R^1$ can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values. The phenyl nucleus can be assigned a Hammett sigma value-derived electron withdrawing characteristic which is the algebraic sum of the Hammett sigma values of its substituents (i.e., those of the substituents, if any, to the phenyl group). For example, the Hammett sigma values of any substituents to the phenyl ring of the phenyl nucleus can be determined algebraically simply by determining from the literature the known Hammett sigma values for each substituent and obtaining the algebraic sum thereof. Electron donating substituents are assigned negative sigma values. For example, in one preferred form, $R^1$ can be a phenyl group which is unsubstituted. The hydrogens attached to the phenyl ring each have a Hammett sigma value of 0 by definition. In another form, the phenyl nuclei can include halogen ring substituents. For example, ortho- or para-chloro or fluoro substituted phenyl groups are specifically contemplated, although the chloro and fluoro groups are each mildly electron withdrawing.

Preferred phenyl group substituents are those which are not electron withdrawing. For example, the phenyl groups can be substituted with straight or branched chain alkyl groups (e.g., methyl, ethyl, n-propyl, isopropyl, n-butyl, isobutyl, n-hexyl, n-octyl, tert-octyl, n-decyl, n-dodecyl and similar groups). The phenyl groups can be substituted with alkoxy groups wherein the alkyl moieties thereof can be chosen from among the alkyl groups described above. The phenyl groups can also be substituted with acylamino groups. Illustrative acylamino groups include acetylamino, propanoylamino, butanoylamino, octanoylamino, benzoylamino, and similar groups.

In one particularly preferred form the alkyl, alkoxy and/or acylamino groups are in turn substituted with a conventional photographic ballast, such as the ballasting moieties of incorporated couplers and other immobile photographic emulsion addenda. The ballast groups typically contain at least eight carbon atoms and can be selected from both aliphatic and aromatic relatively unreactive groups, such as alkyl, alkoxy, phenyl, alkylphenyl, phenoxy, alkylphenoxy and similar groups.

The alkyl and alkoxy groups, including ballasting groups, if any, preferably contain from 1 to 20 carbon atoms, and the acylamino groups, including ballasting groups, if any, preferably contain from 2 to 21 carbon atoms. Generally, up to about 30 or more carbon atoms in these groups are contemplated in their ballasted form. Methoxyphenyl, tolyl (e.g., p-tolyl and m-tolyl) and ballasted butyramidophenyl nuclei are specifically preferred.

Examples of the specifically preferred hydrazine compounds are the following:

1-Formyl-2-(4-[2-(2,4-di-tert-pentylphenoxy)-butyramido]phenyl)hydrazine

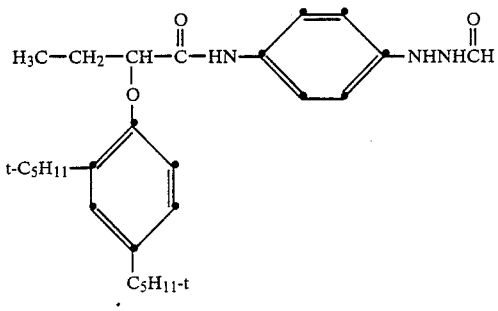

1-Formyl-2-phenylhydrazine

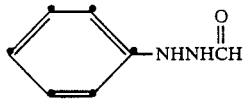

1-Formyl-2-(4-methoxylphenyl)hydrazine

-continued

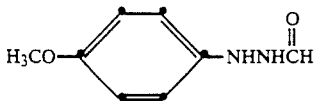

1-Formyl-2-(4-chlorophenyl)hydrazine

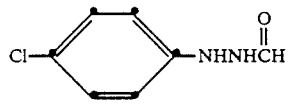

1-Formyl-2-(4-fluorophenyl)hydrazine

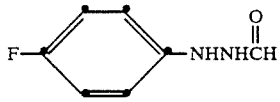

1-Formyl-2-(2-chlorophenyl)hydrazine

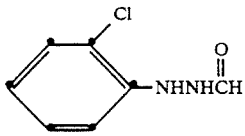

1-Formyl-2-(p-tolyl)hydrazine

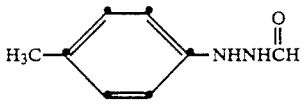

Preferred photographic elements for use in the method of this invention also include those in which the hydrazide comprises an adsorption promoting moiety. Hydrazides of this type contain an unsubstituted or mono-substituted divalent hydrazo moiety and an acyl moiety. The adsorption promoting moiety can be chosen from among those known to promote adsorption of photographic addenda to silver halide grain surfaces. Typically, such moieties contain a sulfur or nitrogen atom capable of complexing with silver or otherwise exhibiting an affinity for the silver halide grain surface. Examples of preferred adsorption promoting moieties include thioureas, heterocyclic thioamides and triazoles. Exemplary hydrazides containing an adsorption promoting moiety include:

1-[4-(2-formylhydrazino)phenyl]-3-methyl thiourea

3-[4-(2-formylhydrazino)phenyl]-5-(3-methyl-2-benzoxazolinylidene)rhodanine-6-([4-(2-formylhydrazino)-phenyl]ureylene)-2-methylbenzothiazole N-(benzotriazol-5-yl)-4-(2-formylhydrazino)-phenylacetamide N-(benzotriazol-5-yl)-3-(5-formylhydrazino-2-methoxyphenyl]propionamide and N-2-(5,5-dimethyl-2-thiomidazol-4-yl-idenimino)ethyl-3-[5-(formylhydrazino)-2-methoxyphenyl]propionamide.

Hydrazine compounds incorporated in the developing solution in the practice of this invention are effective at very low levels of concentration. For example, hydrazine gives effective results in the developing solution in an amount of only 0.1 grams per liter. Hydrazine compounds incorporated in the photographic element are typically employed in a concentration of from about $10^{-4}$ to about $10^{-1}$ mole per mole of silver, more preferably in an amount of from about $5\times10^{-4}$ to about $5\times10^{-2}$ mole per mole of silver, and most preferably in an amount of from about $8\times10^{-4}$ to about $5\times10^{-3}$ mole per mole of silver. The hydrazines containing an adsorption promoting moiety can be used at a level as low as about $5\times10^{-6}$ mole per mole of silver.

An especially preferred class of hydrazine compounds for use in the elements of this invention are the hydrazine compounds described in copending commonly assigned U.S. patent application Ser. No. 167,814, "High Contrast Photographic Element and Emulsion And Process For Their Use", by J. J. Looker, R. E. Leone and L. J. Fleckenstein, filed Mar. 14, 1988. The disclosure of this application is incorporated herein by reference in its entirety.

The hydrazine compounds described in the aforesaid patent application Ser. No. 167,814 have one of the following structural formulae:

I

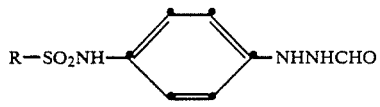

or

II

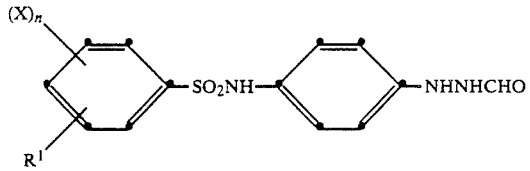

wherein;

R is alkyl having from 6 to 18 carbon atoms or a heterocylic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or $—NHCOR^2$, $—NHSO_2R^2$, $—CONR^2R^3$ or $—SO_2R^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or $—NHCOR—^2$ or $—NHSO_2R^2$ where $R^2$ is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or $—NHCOR^2$ or $—NHSO_2R^2$ where $R^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, fluorine, bromine or iodine. Where more than one X is present, such substituents can be the same or different.

Representative examples of hydrazide nucleating agents within the scope of the aforesaid patent application Ser. No. 167,814 include:

| Compound No. | |
|---|---|
| 1. | 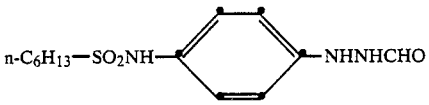 |
| 2. | 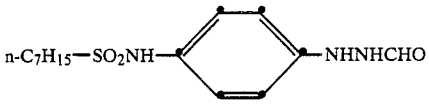 |
| 3. | 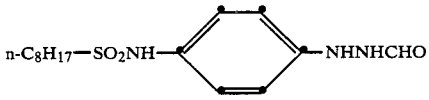 |
| 4. | 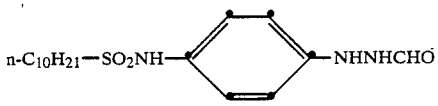 |
| 5. | 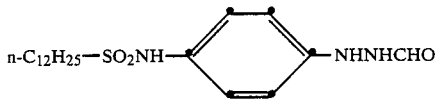 |
| 6. | 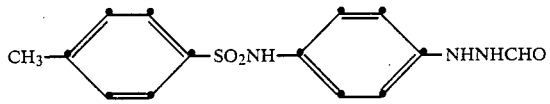 |
| 7. | 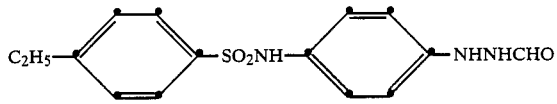 |
| 8. | 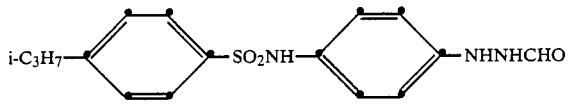 |
| 9. | 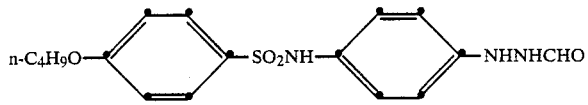 |
| 10. | 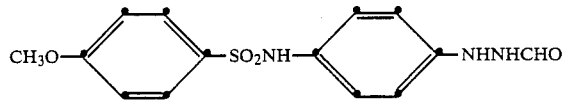 |
| 11. | 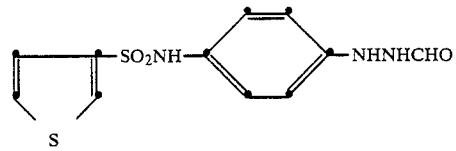 |

-continued

| Compound No. | |
|---|---|
| 12. | 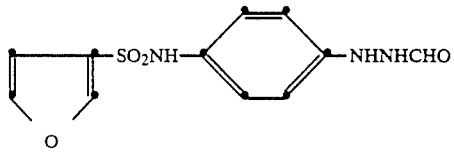 |
| 13. | 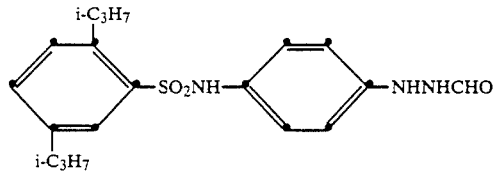 |
| 14. | 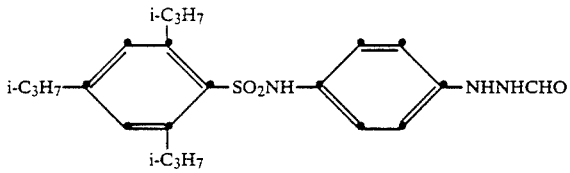 |
| 15. | 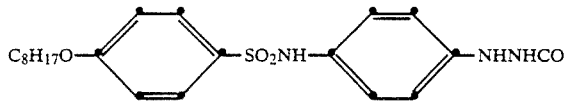 |
| 16. | 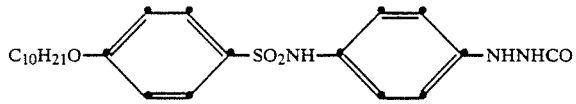 |
| 17. | 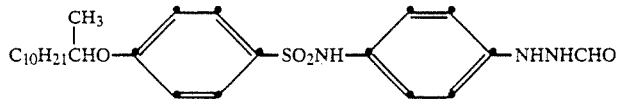 |
| 18. | 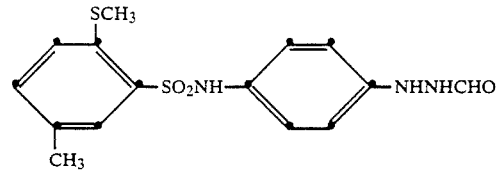 |

The hydrazide compounds described above can be prepared, for example, by reducing 1-formyl-2-(4-nitrophenyl)-hydrazide to the corresponding amine which is then caused to react with an alkyl- or an aryl- sulfonyl halide compound to form the desired sulfonamidophenyl hydrazide.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442 and 4,740,452.

The hydrazide compounds are employed in combination with negative-working photographic emulsions comprised of radiation-sensitive silver halide grains capable of forming a surface latent image and a binder. The silver halide emulsions include high chloride emulsions conventionally employed in forming lithographic photographic elements, as well as silver bromide and silver bromoiodide emulsions which are recognized in the art as being capable of attaining higher photographic speeds. Generally, the iodide content of the silver halide emulsions is less than about 10 mole percent silver iodide, based on total silver halide.

Silver halide grains suitable for use in the emulsions of this invention are capable of forming a surface latent image, as opposed to being of the internal latent image-forming type. Surface latent image silver halide grains are employed in the majority of negative-working silver halide emulsions, whereas internal latent image-forming silver halide grains, while capable of forming a negative image when developed in an internal developer, are usually employed with surface developers to form direct-positive images. The distinction between surface latent image and internal latent image silver halide grains is generally well recognized in the art.

The silver halide grains, when the emulsions are used for lith applications, have a mean grain size of not larger than about 0.7 micron, preferably about 0.4 micron or less. Mean grain size is well understood by those skilled in the art, and is illustrated by Mees and James, *The Theory of the Photographic Process*, 3rd Ed., MacMillan 1966, Chapter 1, pp. 36–43. The photographic emulsions can be coated to provide emulsion layers in the photographic elements of any conventional silver coverage. Conventional silver coverages fall within the range of from about 0.5 to about 10 grams per square meter.

As is generally recognized in the art, higher contrasts can be achieved by employing relatively monodispersed emulsions. Monodispersed emulsions are characterized by a large proportion of the silver halide grains falling within a relatively narrow size-frequency distribution. In quantitative terms, monodispersed emulsions have been defined as those in which 90 percent by weight or by number of the silver halide grains are within plus or minus 40 percent of the means grain size.

Silver halide emulsions contain, in addition to silver halide grains, a binder. The proportion of binder can be widely varied, but typically is within the range of from about 20 to 250 grams per mol of silver halide. Excessive binder can have the effect of reducing maximum densities and consequently also reducing contrast. For contrast values of 10 or more it is preferred that the binder be present in a concentration of 250 grams per mol of silver halide, or less.

The binders of the emulsions can be comprised of hydrophilic colloids. Suitable hydrophilic materials include both naturally occurring substances such as proteins, protein derivatives, cellulose derivatives, e.g., cellulose esters, gelatin, e.g., alkali-treated gelatin (pigskin gelatin), gelatin derivatives, e.g., acetylated gelatin, phthalated gelatin and the like, polysaccharides such as dextran, gum arabic, zein, casein, pectin, collagen derivatives, collodion, agar-agar, arrowroot, albumin and the like.

In addition to hydrophilic colloids the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymeric materials constitute from about 20 to 80 percent by weight of the binder.

Suitable synthetic polymer materials can be chosen from among poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, vinyl sulfide copolymers, halogenated styrene polymers, amineacrylamide polymers, polypeptides and the like.

Although the term "binder" is employed in describing the continuous phase of the silver halide emulsions, it is recognized that other terms commonly employed by those skilled in the art, such as carrier or vehicle, can be interchangeably employed. The binders described in connection with the emulsions are also useful in forming undercoating layers, interlayers and overcoating layers of the photographic elements of the invention. Typically the binders are hardened with one or more hardeners, such as those described in Paragraph VII, Product Licensing Index, Vol. 92, Dec. 1971, Item 9232, which disclosure is hereby incorporated by reference.

Emulsions according to this invention having silver halide grains of any conventional geometric form (e.g. regular cubic or octahedral crystalline form) can be prepared by a variety of techniques, e.g., single-jet, double-jet (including continuous removal techniques), accelerated flow rate and interrupted precipitation techniques, as illlustrated by Trivelli and Smith, *The Photographic Journal*, Vol. LXXIX, May, 1939, pp. 330–338, T. H. James, *The Theory of the Photographic Process*, 4th Ed., MacMillan, 1977, Chapter 3; Terwilliger et al Research Disclosure, Vol. 149, Sept. 1976, Item 14987, as well as U.S. Pat. Nos. 2,222,264; 3,650,757; 3,672,900; 3,917,485; 3,790,387; 3,761,276 and 3,979,213, and German OLS No. 2,107,118 and U.K. Patent Publication Nos. 335,925; 1,430,465 and 1,469,480, which publications are incorporated herein by reference.

Double jet accelerated flow rate precipitation techniques are preferred for forming monodispersed emulsions. Sensitizing compounds, such as compounds of copper, thallium, cadmium, rhodium, tungsten, thorium, iridium and mixtures thereof, can be present during precipitation of the silver halide emulsion, as illustrated by U.S. Pat. Nos. 1,195,432; 1,951,933; 2,628,167; 2,950,972; 3,488,709; and 3,737,313, all incorporated herein by reference.

The individual reactants can be added to the reaction vessel through surface or sub-surface delivery tubes by gravity feed or by delivery apparatus for maintaining control of the pH and/or pAg of the reaction vessel contents, as illustrated by U.S. Pat. Nos. 3,821,002 and 3,031,304 and Claes et al, Photographische Korrespondenz, 102 Band, Number 10, 1967, p. 162. In order to obtain rapid distribution of the reactants within the reaction vessel, specially constructed mixing devices can be employed as illustrated by U.S. Pat. Nos. 2,996,287; 3,342,605; 3,415,650; and 3,785,777; and German OLS Nos. 2,556,885 and 2,555,364. An enclosed reaction vessel can be employed to receive and to mix reactants upstream of the main reaction vessel, as illustrated by U.S. Pat. Nos. 3,897,935 and 3,790,386.

The grain size distribution of the silver halide emulsions can be controlled by silver halide grain separation techniques or by blending silver halide emulsions of differing grain sizes. The emulsions can include ammonical emulsions, as illustrated by Glafkides, *Photographic Chemistry*, Vol. 1, Fountain Press, London, 1958, pp. 365–368 and 301–304; thiocyanate ripened emulsions, as illustrated by U.S. Pat. No. 3,320,069; thioether ripened emulsions, as illustrated by U.S. Pat. Nos. 3,271,157; 3,574,628 and 3,737,313 or emulsions containing weak silver halide solvents, such as ammonium salts, as illustrated by U.S. Pat. No. 3,784,381 and *Research Disclosure*, Vol. 134, June 1975, Item 13452.

The silver halide emulsion can be unwashed or washed to remove soluble salts. The soluble salts can be removed by chill setting and leaching, as illustrated by U.S. Pat. Nos. 2,316,845 and 3,396,027; by coagulation washing, as illustrated by U.S. Pat. Nos. 2,618,556; 2,614,928; 2,565,418; 3,241,969 and 2,489,341 and by U.K. Patent Nos. 1,035,409 and 1,167,159; by centrifugation and decantation of a coagulated emulsion, as illustrated by U.S. Pat. Nos. 2,463,794; 3,707,378; 2,996,287 and 3,498,454; by employing hydrocyclones alone or in combination with centrifuges, as illustrated by U.K. Patent Nos. 336,692 and 1,356,573; by diafiltration with a semipermeable membrane, as illustrated by *Research Disclosure*, Vol. 102, Oct. 1972, Item 10208. The emulsions, with or without sensitizers, can be dried and stored prior to use as illustrated by *Research Disclosure*, Vol. 101, Sept. 1972, Item 10152.

The silver halide emulsions can be chemically sensitized with active gelatin, as illustrated by T. H. James, *The Theory of the Photographic Process*, 4th Ed., MacMillan, 1977, pp. 67–76, or with sulfur, selenium, tellurium, platinum, palladium, iridium, osmium, rhenium or phosphorus sensitizers or combinations of these sensitizers, such as at pAg levels of from 5 to 10, pH levels of from 5 to 8 and temperatures of from 30° to 80° C., as illustrated by *Research Disclosure*, Vol. 134, June 1975, Item 13452. The emulsions need not be chemically sensitized, however, in order to exhibit the advantages of this invention.

The silver halide emulsions can be spectrally sensitized with dyes from a variety of classes, including the polymethine dye class, which includes the cyanines, merocyanines, complex cyanines and merocyanines (i.e., tri-, tetra- and polynuclear cyanines and merocyanines), oxonols, hemioxonols, styryls, merostyryls and streptocyanines.

By suitable choice of substituent groups the dyes can be cationic, anionic or nonionic. Preferred dyes are cationic cyanine and merocyanine dyes. Emulsions containing cyanine and merocyanine dyes have been observed to exhibit relatively high contrasts. Spectral sensitizing dyes specifically preferred for use in the practice of this invention are as follows:

SS-1: Anhydro-5,5′-dichloro-9-ethyl-3,3′-bis(3-sulfopropyl)oxacarbocyanine hydroxide, sodium salt SS-2: 5,5′,6,6′-Tetrachloro-1,1′,3,3′-tetraethylbenzimidazolocarbocyanine iodide SS-3: 3,3′-Diethyl-9-methylthiacarbocyanine bromide SS-4: 3,3′-Diethyloxacarbocyanine iodide SS-5: 5,5′-Dichloro-3,3′,9-triethylthiacarbocyanine bromide SS-6: 3,3′-Diethylthiocarbocyanine iodide SS-7: 5,5′-Dichloro-2,2′-diethylthiocarbocyanine, p-toluene sulfonate salt SS-8: 3-Carboxymethyl-5-[(3-methyl-2-thiazolidinylidene)-1-methylethylidene]rhodanine SS-9: 3-Ethyl-3-[3-ethyl-2-thiazolidinylidene)-1-methylethylidene]rhodanine SS-10: 5-[(3-(2-Carboxyethyl)-2-thiazolidinylidene)ethylidene]-3-ethylrhodanine SS-11: 1-Carboxymethyl-5-[(3-ethyl-2-benzothiazolinylidene)ethylidene]-3-phenyl-2-thiohydantoin SS-12: 1-Carboxymethyl-5-[(1-ethyl-2(H)-naphtho[1,2-d]thiazolin-2-ylidene)ethylidene]-3-phenyl-2-thiohydantoin SS-13: 3-Carboxymethyl-5-[(3-ethyl-2-benzothiazolinylidene)ethylidene]rhodanine SS-14: 5-[3-Ethyl-2-benzoxazolinylidene)ethylidene]-3-heptyl-2-thio-2,4-oxazolidinedione SS-15: 3-Carboxymethyl-5-(3-ethyl-2-benzothiazolinylidene)rhodanine SS-16: 3-Carboxymethyl-5-(3-methyl-2-benzoxazolinylidene)rhodanine SS-17: 3-Ethyl-5-[3-ethyl-2-benzoxazolinylidene)ethylidene]rhodanine.

The photographic elements can be protected against fog by incorporation of antifoggants and stabilizers in the element itself or in the developer in which the element is to be processed. Illustrative of conventional antifoggants and stabilizers useful for this purpose are those disclosed by Paragraph V, *Product Licensing Index*, Vol. 92, Dec. 1971, Item 9232, which publication is hereby incorporated by reference.

It has been observed that both fog reduction and an increase in contrast can be obtained by employing benzotriazole antifoggants either in the photographic element or the developer in which the element is processed. The benzotriazole can be located in the emulsion layer or in any other hydrophilic colloid layer of the photographic element in a concentration in the range of from about $10^{-4}$ to $10^{-1}$, preferably $10^{-3}$ to $3\times10^{-2}$, mol per mol of silver. When the benzotriazole antifoggant is added to the developer, it is employed in a concentration of from $10^{-6}$ to about $10^{-1}$, preferably $3\times10^{-5}$ to $3\times10^{-2}$, mol per liter of developer.

Useful benzotriazoles can be chosen from among conventional benzotriazole antifoggants. These include benzotriazole (that is, the unsubstituted benzotriazole compound), halo-substituted benzotriazoles (e.g., 5-chlorobenzotriazole, 4-bromobenzotriazole and 4-chlorobenzotriazole) and alkyl-substituted benzotriazoles wherein the alkyl moiety contains from 1 to about 12 carbon atoms (e.g., 5-methylbenzotriazole).

In addition to the components of the photographic emulsions and other hydrophilic colloid layers described above it is appreciated that other conventional element addenda compatible with obtaining relatively high contrast images can be present. For example, addenda can be present in the described photographic elements and emulsions in order to stabilize sensitivity. Preferred addenda of this type include carboxyalkyl substituted 3H-thiazoline-2-thione compounds of the type described in U.S. Pat. No. 4,634,661. Also, the photographic elements can contain developing agents (described below in connection with the processing steps), development modifiers, plasticizers and lubricants, coating aids, antistatic materials, matting agents, brighteners and color materials, these conventional materials being illustrated in Paragraphs IV, VI, IX, XII, XIII, XIV and XXII of *Product Licensing Index*, Vol. 92, Dec. 1971, Item 9232, incorporated herein by reference.

The hydrazide compounds, sensitizing dyes and other addenda incorporated into layers of the photographic elements can be dissolved and added prior to coating either from water or organic solvent solutions, depending upon the solubility of the addenda. Ultrasound can be employed to dissolve addenda. Semipermeable and ion exchange membranes can be used to introduce addenda, such as water soluble ions (e.g. chemical sensitizers). Hydrophobic addenda, particularly those which need not be adsorbed to the silver halide grain surfaces to be effective, such as couplers, redox dye-releasers and the like, can be mechanically dispersed directly or in high boiling (coupler) solvents, as illustrated in U.S. Pat. Nos. 2,322,027 and 2,801,171, or the hydrophobic addenda can be loaded into latices and dispersed, as illustrated by *Research Disclosure*, Vol. 159, July 1977, Item 15930.

In forming photographic elements the layers can be coated on photographic supports by various procedures, including immersion or dip coating, roller coating, reverse roll coating, doctor blade coating, gravure coating, spray coating, extrusion coating, bead coating, stretch-flow coating and curtain coating. High speed coating using a pressure differential is illustrated by U.S. Pat. No. 2,681,294.

The layers of the photographic elements can be coated on a variety of supports. Typical photographic supports include polymeric film, wood fiber, e.g., paper, metallic sheet or foil, glass and ceramic supporting elements provided with one or more subbing layers to enhance the adhesive, antistatic, dimensional, abrasive, hardness, frictional, antihalation and/or other properties of the support surface.

Typical of useful polymeric film supports are films of cellulose nitrate and cellulose esters such as cellulose triacetate and diacetate, polystyrene, polyamines, homo- and co-polymers of vinyl chloride, poly(vinyl acetal), polycarbonate, homo- and copolymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an $\alpha$-olefin containing 2 to 10 carbon atoms, such as polyethylene, polypropylene, copolymers of ethylene and propylene and the like.

Polyolefins, such as polyethylene, polypropylene and polyallomers, e.g., copolymers of ethylene with propylene, as illustrated by U.S. Pat. No. 4,478,128, are preferably employed as resin coatings over paper, as illustrated by U.S. Pat. Nos. 3,411,908 and 3,630,740, over polystyrene and polyester film supports, as illustrated by U.S. Pat. No. 3,630,742, or can be employed as unitary flexible reflection supports, as illustrated by U.S. Pat. No. 3,973,963.

Preferred cellulose ester supports are cellulose triacetate supports, as illustrated by U.S. Pat. Nos. 2,492,977; 2,492,978 and 2,739,069, as well as mixed cellulose ester supports, such as cellulose acetate propionate and cellulose acetate butyrate, as illustrated by U.S. Pat. No. 2,739,070.

Preferred polyester film supports are comprised of linear polyester, such as illustrated by U.S. Pat. Nos. 2,627,088; 2,720,503; 2,779,684 and 2,901,466.

The photographic elements can be imagewise exposed with various forms of energy, which encompass the ultraviolet and visible (e.g., actinic) and infrared regions of the electromagnetic spectrum as well as electron beam and beta radiation, gamma ray, X-ray, alpha particle, neutron radiation and other forms of corpuscular and wavelike radiant energy in either noncoherent (random phase) forms or coherent (in phase) forms, as produced by lasers. Exposures can be monochromatic, orthochromatic or panchromatic. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process*, 4th Ed., MacMillan, 1977, Chapters 4, 6, 17 18 and 23.

The light-sensitive silver halide contained in the photographic elements can be processed following exposure to form a visible image by associating the silver halide with an aqueous alkaline medium in the presence of a developing agent contained in the medium or the element. It is a distinct advantage of the present invention that the described photographic elements can be processed in conventional developers as opposed to specialized developers conventionally employed in conjunction with lithographic photographic elements to obtain very high contrast images. When the photographic elements contain incorporated developing agents, the elements can be processed in the presence of an activator, which can be identical to the developer in composition, but otherwise lacking a developing agent. Very high contrast images can be obtained at pH values in the range of from 11 to 12.3, but preferably lower pH values, for example below 11 and most preferably in the range of about 9 to about 10.8 are preferably employed with the photographic recording materials as described herein.

The developers are typically aqueous solutions, although organic solvents, such as diethylene glycol, can also be included to facilitate the solvency of organic components. The developers contain one or a combination of conventional developing agents, such as a polyhydroxybenzene, aminophenol, para-phenylenediamine, ascorbic acid, pyrazolidone, pyrazolone, pyrimidine, dithionite, hydroxylamine or other conventional developing agents. It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulfate can be incorporated into the developer. Also, compounds such as sodium thiocyanate can be present to reduce granularity. Chelating and sequestering agents, such as ethylenediaminetetraacetic acid or its sodium salt, can be present. Generally, any conventional developer composition can be employed in the practice of this invention. Specific illustrative photographic developers are disclosed in the Handbook of Chemistry and Physics, 36th Edition, under the title "Photographic Formulae" at page 3001 et seq. and in Processing Chemicals and Formulas, 6th Edition, published by Eastman Kodak Company (1963), the disclosures of which are here incorporated by reference. The photographic elements can, of course, be processed with conventional developers for lithographic photographic elements, as illustrated by U.S. Pat. No. 3,573,914 and U.K. Patent No. 376,600.

*Product Licensing Index and Research Disclosure* are published by Kenneth Mason Publications, Ltd., The Old Harbourmaster's, 8 North Street, Emsworth, Hampshire PO10 7DD, ENGLAND.

It is preferred that the novel photographic elements of this invention are processed in developing compositions containing a dihydroxybenzene developing agent. It is more preferred that they are processed in a developing composition containing an auxiliary super-additive developing agent in addition to the dihydroxybenzene which functions as the primary developing agent.

It is especially preferred that the auxiliary super-additive developing agent be a 3-pyrazolidone.

The dihydroxybenzene developing agents employed in the method of this invention are well known and widely used in photographic processing. The preferred developing agent of this class is hydroquinone. Other useful dihydroxybenzene developing agents include:

chlorohydroquinone,
bromohydroquinone,
isopropylhydroquinone,
toluhydroquinone,
methylhydroquinone,
2,3-dichlorohydroquinone,
2,5-dimethylhydroquinone,
2,3-dibromohydroquinone,
1,4-dihydroxy-2-acetophenone-2,5-dimethylhydroquinone,
2,5-diethylhydroquinone,
2,5-di-p-phenethylhydroquinone,
2,5-dibenzoylaminohydroquinone,
2,5-diacetaminohydroquinone,
and the like.

The auxiliary super-additive developing agents employed in the aqueous alkaline developing solutions are also well known and widely used in photographic processing. As explained in Mason, "Photographic Processing Chemistry", Focal Press, London, 1975, "super-additivity" refers to a synergistic effect whereby the combined activity of a mixture of two developing agents is greater than the sum of the two activities when each agent is used alone in the same developing solution (Note especially the paragraph entitled, "Superadditivity" on Page 29 of Mason).

For the purposes of this invention, the preferred auxiliary super-additive developing agents are the 3-pyrazolidone developing agents. Particularly preferred developing agents of this class are those represented by the formula:

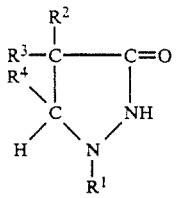

in which $R^1$ is aryl (including substituted aryl) and $R^2$, $R^3$, and $R^4$ are hydrogen or alkyl (including substituted alkyl). Included within the definition of $R^1$ are phenyl and phenyl substituted with groups such as methyl, chloro, amino, methylamino, acetylamino, methoxy and methylsulfonamidoethyl. Included within the definition of $R^2$, $R^3$ and $R^4$ are unsubstituted alkyl and alkyl substituted with groups such as hydroxy, carboxy, or sulfo. The most commonly used developing agents of this class are 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4,4-dihydroxymethyl-3-pyrazolidone. Other useful 3-pyrazolidone developing agents include:

1-phenyl-5-methyl-3-pyrazolidone,
1-phenyl-4,4-diethyl-3-pyrazolidone,
1-p-aminophenyl-4-methyl-4-propyl-3-pyrazolidone,
1-p-chlorophenyl-4-methyl-4-ethyl-3-pyrazolidone,
1-p-acetamidophenyl-4,4-diethyl-3-pyrazolidone,
1-p-betahydroxyethylphenyl-4,4-dimethyl-3-pyrazolidone,
1-p-hydroxyphenyl-4,4-dimethyl-3-pyrazolidone,
1-p-methoxyphenyl-4,4-diethyl-3-pyrazolidone,
1-p-tolyl-4,4-dimethyl-3-pyrazolidone,
and the like.

Less preferred but also useful auxiliary super-additive developing agents for use in the method of this invention are the aminophenols. Examples of useful aminophenols include:

p-aminophenol
o-aminophenol
p-methylaminophenol sulfate
2,4-diaminophenol hydrochloride
N-(4-hydroxyphenyl)glycine
p-benzylaminophenol hydrochloride
2,4-diamino-6-methylphenol
2,4-diaminoresorcinol
N-(beta-hydroxyethyl)-p-aminophenol
and the like.

More than one auxiliary super-additive developing agent can be incorporated in the developing solution if desired. For example, the developing solution can contain hydroquinone, 1-phenyl-3-pyrazolidone, and p-methylaminophenol sulfate. More than one dihydroxybenzene developing agent can, of course, also be utilized, if desired.

Suitable buffering agents, such as borates, carbonates and phosphates can be included in the developing solution to provide adequate buffering capacity.

The aqueous alkaline photographic developing compositions employed herein preferably contain a sulfite preservative at a level sufficient to protect the developing agents against serial oxidation and thereby promote good stability characteristics. Useful sulfite preservatives include sulfites, bisulfites, metabisulfites, and carbonyl bisulfite adducts. Typical examples of sulfite preservatives include:

sodium sulfite,
potassium sulfite,
lithium sulfite,
ammonium sulfite,
sodium bisulfite,
potassium metabisulfite,
sodium formaldehyde bisulfite,
and the like.

Other anti-oxidants such as hydroxylamine and ascorbic acid can be used instead of or in combination with the sulfites.

The aqueous alkaline developing solutions can vary widely in regard to the concentration of the various ingredients included therein. Typically, the dihydroxybenzene developing agent is used in an amount of from about 0.045 to about 0.65 moles per liter, more preferably in an amount of about 0.09 to about 0.36 moles per liter; the auxiliary super-additive developing agent is used in an amount of from about 0.0005 to about 0.01 moles per liter, more preferably in an amount of from about 0.001 to about 0.005 moles per liter; and the sulfite preservative is used in an amount of from about 0.04 to about 0.80 moles per liter, more preferably in an amount of from about 0.12 to about 0.60 moles per liter.

As previously described herein, an amino compound is incorporated in the photographic element in accordance with this invention as an "incorporated bosster". The amino compounds which have been found to be effective for this purpose are amino compounds which:

(1) comprise at least one secondary or tertiary amino group;

(2) contain within their structure a group comprised of at least three repeating ethyleneoxy units, and (3) have a partition coefficient of at least one.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound. The preferred amino compounds have a partition coefficient of at least three, while the most preferred have a partition coefficient of at least four.

The amino compound utilized as an "incorporated booster" is typically employed in an amount of from about 1 to about 25 millimoles per mole of silver, and more preferably in an amount of from about 5 to about 15 millimoles per mole of silver.

Representative examples of amino compounds suitable for use as "incorporated boosters" in accordance with this invention include the following:

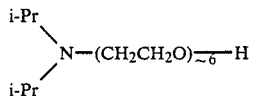

I.

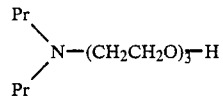

II.

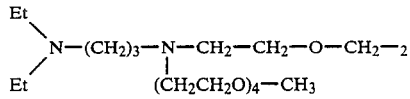

III.

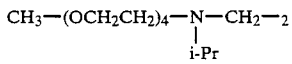

IV.

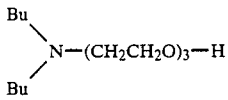

V.

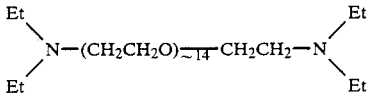

VI.

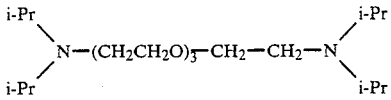

VII.

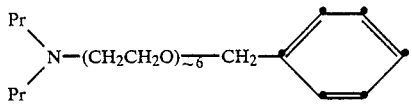

VIII.

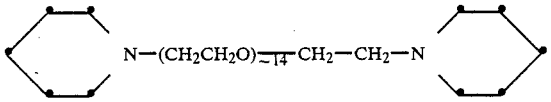

IX.

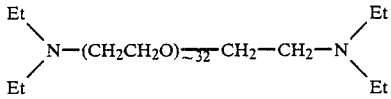

X.

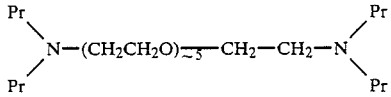

XI.

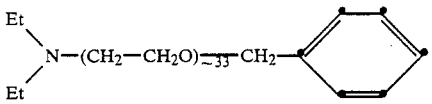

XII.

-continued

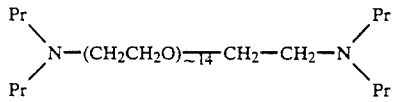

XIII.

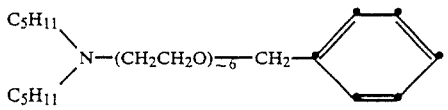

XIV.

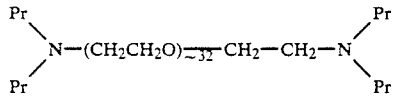

XV.

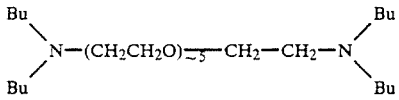

XVI.

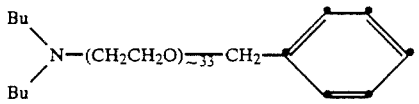

XVII.

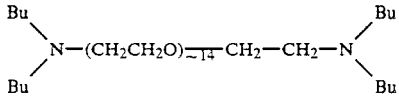

XVIII.

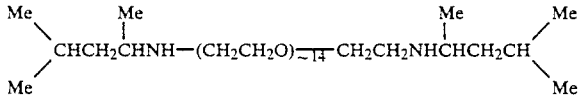

XIX.

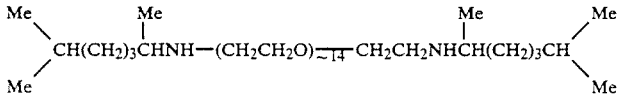

XX.

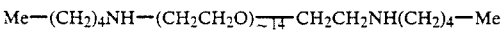

XXI.

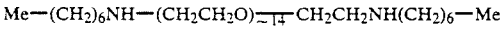

XXII.

In the above formulae, "Me" represents methyl, "Et" represents ethyl, "Pr" represents propyl, "i-Pr" represents isopropyl and "Bu" represents butyl.

Synthesis of secondary or tertiary amino compounds containing an ethyleneoxy group in their structure can be carried out by any of several well known reactions.

An illustrative synthesis for compound I is as follows, where R is an isopropyl group and n is an integer with a value of approximately six:

$$R_2NH + Cl(CH_2CH_2O)_n-H \xrightarrow[\text{48 hours}]{\text{120-200° C.}} R_2N-(CH_2CH_2O)_n-H + HCl$$

An illustrative synthesis for compound IV is as follows where R is an isopropyl group:

Step 1

$$CH_3O(CH_2CH_2O)_4H + CH_3SO_2Cl \xrightarrow[\text{24 hours}]{\text{CH}_2\text{Cl}_2,\ \text{Et}_3\text{N},\ \text{room temperature}} CH_3O(CH_2CH_2O)_4SO_2CH_3 + HCl$$

Step 2

$$CH_3O(CH_2CH_2O)_4SO_2CH_3 + RNH-CH_2CH_2-NHR \xrightarrow[\text{48 hours}]{\text{K}_2\text{CO}_3,\ \text{100° C.}} [CH_3-(OCH_2CH_2)_4-NR-CH_2-]_2$$

An illustrative synthesis for compound VII is as follows where R is an isopropyl group:

Step 1

$$HO(CH_2CH_2O)_4-H + CH_3SO_2Cl \xrightarrow[\text{48 hours}]{\text{CH}_2\text{Cl}_2,\ \text{ET}_3\text{N},\ \text{room temperature}} CH_3SO_2O(CH_2CH_2O)_4SO_2CH_3 + HCl$$

Step 2

-continued $$CH_3SO_2O(CH_2CH_2O)_4SO_2CH_3 + RNH \xrightarrow[48\ \text{hours}]{200^\circ\ C.} R_2N-(CH_2CH_2O)_3-CH_2CH_2-NR_2$$

An illustrative synthesis for compound XII is as follows where Ph is phenyl, R is ethyl, and n is an integer with a value of approximately 33:

Step 1

$$HO(CH_2CH_2O)_n-H + PhCH_2Cl \xrightarrow[24\ \text{hours}]{NaOH,\ 100^\circ\ C.} HO(CH_2CH_2O)_nCH_2Ph + HCl$$

Step 2

$$HO(CH_2CH_2O)_nCH_2Ph + CH_3PhSO_2Cl \xrightarrow[0^\circ\ C.\ 5\ \text{hours}]{H_2O,THF,NaOH} CH_3PhSO_2O(CH_2CH_2O)_nCH_2Ph$$

Step 3

$$CH_3PhSO_2O(CH_2CH_2O)_nCH_2Ph + R_2NH \xrightarrow[\text{Reflux, 3-4 days}]{MeCN,\ Na_2CO_3} R_2N(CH_2CH_2O)_nCH_2Ph$$

To carry out the synthesis of compound XIII, polyethylene glycol 600 (300 grams, 0.50 moles) and dimethylaminopyridine (6.1 grams, 0.05 moles) were dissolved in 400 milliliters of dry tetrahydrofuran and the solution was cooled to about −10° C. A solution of p-toluenesulfonyl chloride (238 grams, 1.25 moles) in 400 milliliters of dry tetrahydrofuran was added with vigorous stirring over a 30-minute period, keeping the reaction temperature at −7° to −3° C. The reaction mixture was stirred at −5° C. for 2 hours and at 0° C. for 16 hours, and then added to 2 liters of ice water and extracted three times with 500 milliliters of dichloromethane. The combined organic extracts were washed with 10% hydrochloric acid and water, dried with anhydrous magnesium sulfate and filtered and the solvent was removed on a rotary evaporator. The product (425 grams, 86% yield) was a golden viscous oil identified as poly(ethyleneglycol)di-p-toluenesulfonate ester with the structure, as confirmed by nuclear magnetic resonance analysis, of:

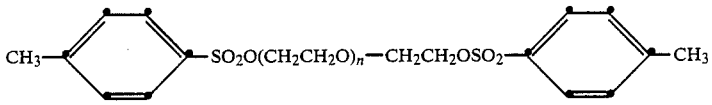

where n = ~13.

Poly(ethyleneglycol)di-p-toluenesulfonate ester (197.4 grams, 0.20 moles) and dipropylamine (60.7 grams, 0.60 moles) were dissolved in 400 milliliters of dry acetonitrile and then anhydrous sodium carbonate (63.6 grams, 0.60 moles) was added and the reaction mixture was heated under reflux with vigorous stirring for 4 days. The reaction mixture was cooled and filtered and the solvent was evaporated on a rotary evaporator. The residual oil was dissolved in 1.5 liters of dichloromethane, washed with water and extracted three times with 500 milliliters of 10% hydrochloric acid. The combined extracts were neutralized with 50% sodium hydroxide and extracted three times with 500 milliliters of dichloromethane. To the combined extracts was added 200 milliliters of 25% sodium hydroxide, and the mixture was heated with stirring under reflux for 1 hour. The mixture was cooled; the organic layer was separated, washed with water, dried with anhydrous magnesium sulfate and filtered, and the solvent was removed on a rotary evaporator. The product (87.2 grams, 52% yield) was an amber oil with the structure, as confirmed by nuclear magnetic resonance, of:

$$Pr_2N(CH_2CH_2O)_nCH_2CH_2NPr_2$$

where n = ~14.

To synthesize compound XXI, 40.7 grams (0.04 mole) of poly(ethyleneglycol)di-p-toluenesulfonate ester, 18.3 mL (0.16 mole) of n-pentyl amine and 21.2 grams (0.20 mole) of anhydrous $Na_2CO_3$ were suspended in dry acetonitrile (100 mL) and heated with stirring under reflux for 24 hours. The reaction mixture was cooled, the solid was filtered off and the solvent was removed. The residual oil was dissolved in methylene chloride (1 L) and heated with stirring under reflux with NaOH (25%, 250 mL) for 2 hours. The reaction mixture was cooled and the organic layer was separated and washed with 10% NaOH (500 mL), water (2×500 mL) and brine (500 mL). The solution was dried with anhydrous $MgSO_4$ and filtered and the solvent was removed. The residual oil was chromatographed on silica gel. Elution with 90% methylene chloride, 10% methanol and 1% triethylamine and removal of solvent (3 hours at 60° C./1 mm) gave 15.6 grams (48% yield) of product as a yellow oil. The structure of compound XXI was confirmed by nuclear magnetic resonance analysis.

The invention is further illustrated by the following examples of its practice.

EXAMPLES 1 TO 18

Each coating used in the following examples was prepared on a polyester support, using a mono-dispersed 0.24 μm AgBrI (2.5 mol % iodide) iridium-doped emulsion at 3.47 g/m² Ag, 2.24 g gel/m², and 0.96 g latex/m² where the latex is a copolymer of methyl acrylate, 2-acrylamido-2-methylpropane-sulfonic acid, and 2-acetoacetoxyethylmethylacrylate. The silver halide emulsion was spectrally sensitized with 216 mg/Ag mol of anhydro-5,5'-dichloro-9-ethyl-3,3'-di-(3-sulfopropyl) oxacarbocyanine hydroxide, triethylene salt. The nucleating agent was added as a methanol solution to the emulsion melts at a level of 0.0247 g/m². The emulsion layer was overcoated with gelatin containing polymethylmethacrylate beads. The structure of the nucleating agent employed was as follows:

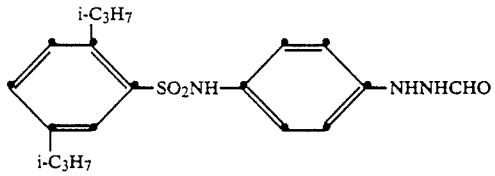

The "incorporated booster" was added to the emulsion melt as a methanol solution in the amount indicated in the example.

Coatings were exposed for one second to a 3000° K. tungsten light source and processed for 2 minutes at 35° C. in the developer solution.

To prepare the developer solution, a concentrate was prepared from the following ingredients:

| | |
|---|---|
| Sodium metabisulfite | 145 g |
| 45% Potassium hydroxide | 178 g |
| Diethylenetriamine pentaacetic acid pentasodium salt (40% solution) | 15 g |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 47% Potassium Carbonate | 120 g |
| Water to one liter | |

The concentrate was diluted at a ratio of one part of concentrate to four parts of water to produce a working strength developing solution with a pH of 10.4

In the examples which follow, the sensitometry parameters reported are:

CR=relative speed (relative log E speed X 100)

EC=effective contrast (the average slope between density values of 0.1 and 2.50)

PDP=practical density point (density at 0.4 log E beyond $D_{net}=0.6$)

DQ=dot quality (a subjective rating on a scale from 1 (very poor) to 5 (excellent). A rating of 3 is judged to be satisfactory quality).

Sensitometry parameters are expressed in the following Table I in terms of the change produced by incorporation of the booster compound versus the non-booster control processed under identical conditions. Therefore, the speed, contrast and PDP increases produced by the boosters are directly recorded in this table. By definition, the delta CR, delta EC and delta PDP for the non-booster control in the table are zero.

The term "partition coefficient", as used herein, refers to the log P value of the booster compound with respect to the system n-octanol/water as defined by the equation:

$$\log P = \log \frac{[X]_{octanol}}{[X]_{water}}$$

where X=concentration of the booster compound. The partition coefficient is a measure of the ability of the compound to partition between aqueous and organic phases and is calculated in the manner described in an article by A. Leo, P.Y.C. Jow, C. Silipo and C. Hansch, Journal of Medicinal Chemistry, Vol. 18, No. 9, pp. 865–868, 1975. Calculations for log P can be carried out using MedChem software, version 3.52, Pomona College, Claremont, California. The higher the value of log P the more hydrophobic the compound.

TABLE I

| Booster | Log P | Coverage (mmol/Agmol) | Delta CR | Delta EC | Delta PDP | DQ |
|---|---|---|---|---|---|---|
| None | — | — | 0 | 0 | 0 | 1 |
| Compound I | 1.20 | 7.42 | +5 | +0.8 | +0.38 | 2 |
| | 1.20 | 14.84 | +15 | +1.4 | +0.36 | 2 |
| Compound II | 1.43 | 5.72 | +2 | +0.2 | +0.07 | 1 |
| Compound III | 1.65 | 1.77 | +8 | +2.0 | +0.66 | 1+ |
| | 1.65 | 3.54 | +12 | +3.4 | +0.73 | 1+ |
| | 1.65 | 5.31 | +14 | +5.9 | +0.98 | 2 |
| Compound IV | 2.28 | 2.54 | +2 | +0.2 | +0.03 | 1 |
| | 2.28 | 5.08 | −1 | 0 | +0.03 | 1 |
| | 2.28 | 10.16 | +1 | +0.3 | +0.10 | 1 |
| Compound V | 2.49 | 4.81 | −3 | +0.7 | +0.43 | 1 |
| Compound VI | 2.80 | 1.69 | +6 | +0.8 | +0.44 | 1 |
| | 2.80 | 3.38 | +9 | +1.6 | +0.70 | 1 |
| | 2.80 | 5.07 | +12 | +1.2 | +0.57 | 1+ |
| Compound VII | 3.28 | 3.69 | +11 | +3.4 | +1.10 | 2 |
| | 3.28 | 7.38 | +7 | +5.5 | +1.54 | 2+ |
| | 3.28 | 7.38 | +1 | +5.0 | +0.71 | 3 |
| | 3.28 | 7.38 | +17 | +14.2 | +1.84 | 3 |
| | 3.28 | 14.76 | +10 | +8.4 | +2.24 | 3 |
| Compound VIII | 3.80 | 1.42 | +2 | +3.4 | +1.29 | 2+ |
| | 3.80 | 4.26 | +8 | +8.5 | +1.91 | 2+ |
| Compound IX | 3.80 | 1.64 | +12 | +2.4 | +0.74 | 1 |
| | 3.80 | 3.28 | +18 | +4.6 | +0.88 | 1+ |
| | 3.80 | 4.92 | +21 | +4.1 | +1.19 | 2 |
| Compound X | 4.00 | 1.49 | +16 | +4.2 | +0.54 | 2 |
| | 4.00 | 4.46 | +15 | +5.9 | +0.86 | 2 |
| Compound XI | 4.30 | 1.44 | +11 | +5.3 | +1.35 | 2 |
| | 4.30 | 4.32 | +17 | +12.8 | +2.11 | 3 |
| Compound XII | 4.40 | 1.46 | +17 | +3.4 | +0.69 | 1+ |
| | 4.40 | 4.37 | +18 | +2.6 | +0.59 | 1+ |
| Compound XIII | 4.90 | 0.79 | +16 | +3.8 | +0.99 | 3 |
| | 4.90 | 1.58 | +19 | +7.4 | +2.01 | 2+ |
| | 4.90 | 1.58 | +17 | +8.6 | +2.07 | 2 |
| | 4.90 | 1.58 | +13 | +7.0 | +1.83 | 3 |

TABLE I-continued

| Booster | Log P | Coverage (mmol/Agmol) | Delta CR | Delta EC | Delta PDP | DQ |
|---|---|---|---|---|---|---|
| | 4.90 | 1.58 | +23 | +7.3 | +1.28 | 3 |
| | 4.90 | 3.16 | +28 | +14.0 | +2.25 | 3 |
| | 4.90 | 3.16 | +25 | +11.8 | +1.42 | 4 |
| | 4.90 | 3.16 | +25 | +10.9 | +2.47 | 3+ |
| | 4.90 | 3.16 | +32 | +10.1 | +1.68 | 3+ |
| | 4.90 | 3.16 | +28 | +14.2 | +1.96 | 4 |
| | 4.90 | 4.74 | +29 | +20.2 | +1.82 | 3 |
| | 4.90 | 4.74 | +30 | +13.3 | +2.22 | 3 |
| | 4.90 | 6.32 | +42 | +13.0 | +1.78 | 4 |
| Compound XIV | 5.90 | 3.80 | +19 | +10.4 | +1.93 | 2+ |
| | 5.90 | 1.27 | +11 | +5.0 | +1.44 | 1+ |
| Compound XV | 6.00 | 1.44 | +28 | +10.2 | +1.65 | 3 |
| | 6.00 | 4.31 | +34 | +12.1 | +1.86 | 3+ |
| Compound XVI | 6.40 | 1.28 | +18 | +11.1 | +2.01 | 2+ |
| | 6.40 | 3.85 | +23 | +16.9 | +2.09 | 3+ |
| Compound XVII | 6.50 | 1.41 | +23 | +8.6 | +1.50 | 2+ |
| | 6.50 | 4.22 | +29 | +12.7 | +1.70 | 3+ |
| Compound XVIII | 7.00 | 1.48 | +30 | +23.4 | +2.19 | 3 |
| | 7.00 | 2.96 | +38 | +20.1 | +2.68 | 3 |
| | 7.00 | 4.44 | +39 | +23.0 | +2.59 | 3 |

The data reported in Table I demonstrate that use of the incorporated boosters of this invention provides a substantial increase in speed, in contrast and in practical density point. Comparison of diamine and monoamine compounds of similar Log P and similar ethyleneoxy chain length indicates that significantly increased booster activity is produced by the second amine function. The data also show the advantage of increased booster activity with increasing value of Log P. There is also increased booster activity with increasing ethyleneoxy chain length for amines of similar molecular structure and similar log P. Increasing the ethyleneoxy chain length provides an effective means of increasing the bulk of the molecule in order to reduce its seasoning out into the developing solution, while at the same time maintaining a practical degree of "dispersability" in the aqueous environment within the emulsion during processing.

EXAMPLES 19 TO 32

The following examples were carried out in a similar manner to examples 1 to 18 except that in preparing the developing solution the concentrate was diluted at a ratio of one part of concentrate to two parts of water to produce a working strength developing solution with a pH of 10.5 and the development time was 1 minute at 35° C. The results obtained are reported in Table II.

TABLE II

| Example No. | Booster | Log P | Coverage (mmol/Agmol) | Delta CR | Delta EC | Delta PDP | DQ |
|---|---|---|---|---|---|---|---|
| Control | None | — | — | 0 | 0 | 0 | 1 |
| 19 | Compound III | 1.65 | 5.31 | +26 | +11.7 | +1.55 | 2+ |
| 20 | Compound VI | 2.80 | 1.69 | +16 | +5.7 | +0.95 | 1+ |
| | | 2.80 | 3.38 | +24 | +8.1 | +1.25 | 1+ |
| | | 2.80 | 5.07 | +29 | +9.0 | +1.35 | 2 |
| 21 | Compound VII | 3.28 | 7.38 | +18 | +12.0 | +2.10 | 3 |
| 22 | Compound VIII | 3.80 | 1.42 | +9 | +10.1 | +1.3 | 2 |
| | | 3.80 | 4.26 | +17 | +20.0 | +2.65 | 3 |
| 23 | Compound IX | 3.80 | 3.80 | +40 | +6.3 | +1.70 | 3 |
| 24 | Compound X | 4.00 | 1.49 | +37 | +19.1 | +1.50 | 3 |
| | | 4.00 | 4.46 | +42 | +17.3 | +1.55 | 4 |
| 25 | Compound XI | 4.30 | 1.44 | +22 | +12.2 | +1.90 | 2+ |
| | | 4.30 | 4.32 | +32 | +18.2 | +3.00 | 3+ |
| 26 | Compound XII | 4.40 | 1.46 | +36 | +24.0 | +1.30 | 2+ |
| | | 4.40 | 4.37 | +41 | +16.1 | +1.75 | 3 |
| 27 | Compound XIII | 4.90 | 1.58 | +34 | +24.6 | +3.00 | 4 |
| | | 4.90 | 3.16 | +45 | +32.8 | +3.10 | 4+ |
| | | 4.90 | 3.16 | +45 | +13.1 | +2.75 | 4 |
| | | 4.90 | 3.16 | +46 | +27.2 | +2.95 | 4+ |
| | | 4.90 | 4.74 | +52 | +30.0 | +3.15 | 4+ |
| | | 4.90 | 4.74 | +48 | +27.1 | +2.55 | 4 |
| 28 | Compound XIV | 5.90 | 1.27 | +17 | +7.1 | +1.30 | 1+ |
| | | 5.90 | 3.80 | +28 | +14.0 | +2.30 | 2+ |
| 29 | Compound XV | 6.00 | 1.44 | +47 | +30.5 | +2.60 | 4+ |
| | | 6.00 | 4.31 | +55 | +17.2 | +2.70 | 4+ |
| 30 | Compound XVI | 6.40 | 1.28 | +22 | +13.9 | +2.25 | 2 |
| | | 6.40 | 3.85 | +34 | +14.6 | +2.40 | 3 |
| 31 | Compound XVII | 6.50 | 1.41 | +38 | +19.5 | +2.10 | 3 |
| | | 6.50 | 4.22 | +46 | +15.5 | +1.90 | 3+ |
| 32 | Compound XVIII | 7.00 | 1.48 | +43 | +23.4 | +3.05 | 4 |
| | | 7.00 | 2.96 | +47 | +27.3 | +2.95 | 4 |
| | | 7.00 | 4.44 | +52 | +22.2 | +3.20 | 4 |

Comparing the data in Table II with that in Table I, it is apparent that speed, contrast, practical density point and dot quality are all significantly affected by the concentration of the developing solution and the time of development. The "incorporated boosters" of this invention are shown to provide excellent results with concentrated developing solutions and short development times.

EXAMPLE 33

This example was carried out using photographic elements similar to those of Examples 1 to 32 except that the nucleating agent employed was a mixture of the hydrazine compound:

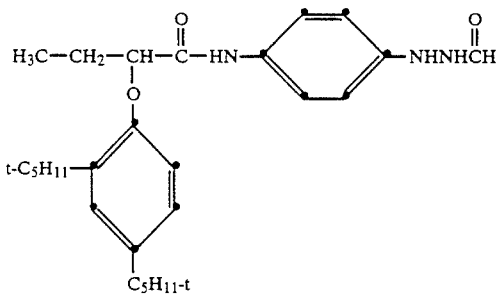

at a coverage of 0.0121 g/m$^2$ and the hydrazine compound:

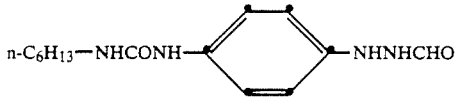

at a coverage of 0.00237 g/m$^2$.

A film designated Film A was prepared with no incorporated booster compound, while a film designated Film B contained 0.0861 g/m$^2$ of Compound XIII. A developing solution, designated Developer A, was formulated from the following ingredients:

| | |
|---|---|
| Pentasodium salt of nitrilotrimethylene-phosphonic acid (40% solution) | 6.6 cc |
| Diethylenetriamine pentaacetic acid pentasodium salt (40% solution) | 3.2 g |
| Sodium bromide | 3 g |
| Phosphoric acid (75% solution) | 47.4 g |
| Potassium hydroxide (45% solution) | 132 g |
| Sodium metabisulfite | 52.5 g |
| Sodium hydroxide (50% solution) | 68 g |
| 1-Phenyl-5-mercaptotetrazole | 12 mg |
| 5-Methylbenzotriazole | 0.25 g |
| Hydroquinone | 35 g |
| 1-Phenyl-4-hydroxymethyl-4-methyl-3-pyrazolidone | 0.3 g |
| 3-Diethylamino-1,2-propanediol | 19.7 g |

-continued

| |
|---|
| Water to one liter |

A second developing solution, designated Developer B, differed from Developer A in that the 3-diethylamino-1,2-propanediol was omitted.

Film A was developed in Developer A at a pH of 11.6 for 80 seconds at 30° C. Film B was developed in Developer B for 80 seconds at 30° C. at pH levels of 11.6, 11.5 and 11.4. The pH's of the developing solutions were adjusted to the designated levels using concentrated potassium hydroxide and concentrated hydrochloric acid. The results obtained are summarized in Table III below.

TABLE III

| Film | Developer | Relative Speed | Contrast | Shoulder Density |
|---|---|---|---|---|
| A | A (pH = 11.6) | 100 | 25 | 5.50 |
| B | B (pH = 11.6) | 178 | 38 | 5.60 |
| B | B (pH = 11.5) | 145 | 37 | 5.60 |
| B | B (pH = 11.4) | 132 | 24 | 5.55 |

The results reported in Table III indicate that use of the incorporated booster of this invention (Compound XIII) in Film B provided more booster activity than use of a highly effective booster compound, namely 3-diethylamino-1,2-propanediol, in Developer A. This is evidenced by the higher speeds, contrasts and shoulder densities that were obtained with the incorporated booster film when it was processed in developing solution that did not contain an amino compound as a contrast-promoting agent. This was true even at reduced pH, as seen by comparing the results for Film B processed in Developer B at pH's of 11.4 and 11.5 compared with Film A processed in Developer A at a pH of 11.6. These results confirm the excellent performance that is achievable with the incorporated boosters described herein.

EXAMPLES 34–39

The following examples were carried out in a similar manner to examples 1 to 18 except that in preparing the developing solution, the concentrate was diluted at a ratio of one part of concentrate to two parts of water to produce a working strength developing solution with a pH of 10.5 and the development time was 72 seconds at 35° C. In these examples, the processing employed was machine processing using a roller transport machine with mild agitation. The results obtained are reported in Table IV.

TABLE IV

| Example No. | Booster | Log P | Coverage (mmol/Agmol) | Delta CR | Delta EC | Delta PDP | DQ |
|---|---|---|---|---|---|---|---|
| Control | None | — | — | 0 | 0 | 0 | 1 |
| 34 | Compound XIII | 4.90 | 1.11 | +22 | +9.4 | +1.31 | 3+ |
| | | 4.90 | 2.22 | +26 | +10.3 | +1.64 | 4 |
| | | 4.90 | 4.44 | +32 | +12.6 | +1.81 | 4+ |
| 35 | Compound XVIII | 7.00 | 1.08 | +24 | +10.7 | +1.61 | 3+ |
| | | 7.00 | 2.17 | +27 | +10.2 | +1.57 | 3+ |
| | | 7.00 | 4.34 | +28 | +9.6 | +1.70 | 3+ |
| 36 | Compound XIX | 4.90 | 1.15 | +10 | +5.1 | +1.18 | 3 |
| | | 4.90 | 2.31 | +11 | +6.5 | +1.30 | 3+ |
| | | 4.90 | 4.62 | +13 | +7.3 | +1.26 | 3+ |
| 37 | Compound XX | 7.00 | 0.93 | +11 | +5.5 | +1.58 | 3 |
| | | 7.00 | 1.86 | +15 | +6.7 | +1.56 | 3+ |
| | | 7.00 | 3.73 | +14 | +6.2 | +1.50 | 3+ |
| 38 | Compound XXI | 4.50 | 1.19 | +15 | +6.9 | +1.79 | 3+ |
| | | 4.50 | 2.38 | +16 | +7.7 | +1.90 | 3+ |
| | | 4.50 | 4.76 | +17 | +7.6 | +1.82 | 4 |

TABLE IV-continued

| Example No. | Booster | Log P | Coverage (mmol/Agmol) | Delta CR | Delta EC | Delta PDP | DQ |
|---|---|---|---|---|---|---|---|
| 39 | Compound XXII | 6.60 | 1.03 | +12 | +5.5 | +1.78 | 3 |
| | | 6.60 | 2.06 | +16 | +6.3 | +1.95 | 3+ |

Considering the data in Table IV, it is apparent that bis-secondary diamines XIX, XX, XXI, and XXII are effective incorporated boosters for the purposes of this invention, but are somewhat less effective than bis-tertiary-diamines XIII and XVIII.

Use of the "incorporated boosters" of this invention provides many important advantages in comparison with the prior art. Thus, for example, they are useful in amounts of less than one-tenth that typically required for boosters included in developing solutions, based on the molar amount of booster employed per unit area of film processed. This results in major economic benefits. In addition there is no problem of odor or condensation of the amino compound. Process consistency is achieved since there is no loss of amino compound from solution with seasoning. Since the booster is included in the photographic element, processing can be carried out with conventional rapid access developers. Of particular importance, the amino compounds described herein are simple in structure, easy to synthesize, low in cost, and very effective.

The invention has been described in detail with particular reference to certain preferred embodiments thereof, but it will be understood that variations and modifications can be effected within the spirit and scope of the invention.

What is claimed is:

1. A silver halide photographic element adapted to form a high contrast image when development is carried out, in the presence of a hydrazine compound, with an aqueous alkaline developing solution, said element including at least one layer comprising, in an amount effective to act as an incorporated booster, an amino compound which (1) comprises at least one secondary or tertiary amino group, (2) contains within its structure a group comprised of at least three repeating ethyleneoxy units, and (3) has a partition coefficient of at least one.

2. A photographic element as claimed in claim 1 wherein said group comprised of at least three repeating ethyleneoxy units is directly linked to a tertiary amino nitrogen atom.

3. A photographic element as claimed in claim 1 wherein said group comprised of at least three repeating ethyleneoxy units is a linking group joining tertiary amino nitrogen atoms of a bis-tertiary amino compound.

4. A photographic element as claimed in claim 1 wherein said amino compound has a partition coefficient of at least three.

5. A photographic element as claimed in claim 1 wherein said amino compound has a partition coefficient of at least four.

6. A photographic element as claimed in claim 1 wherein said amino compound comprises at least 20 carbon atoms.

7. A photographic element as claimed in claim 1 wherein said amino compound is a bis-tertiary amine of the formula:

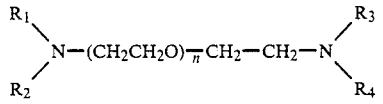

wherein n is an integer with a value of 3 to 50, $R_1$, $R_2$, $R_3$ and $R_4$ are independently alkyl groups of 1 to 8 carbon atoms, $R_1$ and $R_2$ taken together and $R_3$ and $R_4$ taken together represent the atoms necessary to complete a heterocyclic ring.

8. A photographic element as claimed in claim 7 wherein n is an integer with a value of 10 to 50.

9. A photographic element as claimed in claim 1 wherein said amino compound is a bis-secondary amine of the formula:

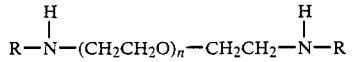

wherein n is an integer with a value of 3 to 50 and each R is independently a linear or branched, substituted or unsubstituted alkyl group of at least 4 carbon atoms.

10. A photographic element as claimed in claim 1 wherein said amino compound has the formula:

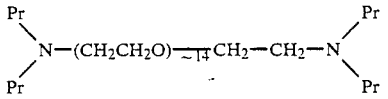

11. A photographic element as claimed in claim 1 wherein said amino compound has the formula:

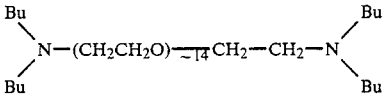

12. A photographic element as claimed in claim 1 wherein said amino compound has the formula:

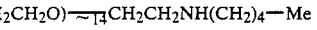

13. A photographic element as claimed in claim 1 wherein at least one layer of said element contains a hydrazine compound.

14. A photographic element as claimed in claim 1 wherein at least one layer of said element contains a hydrazine compound of the formula:

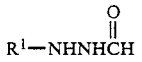

wherein $R^1$ is a phenyl nucleus having a Hammett sigma value-derived electron withdrawing characteristic of less than +0.30.

15. A photographic element as claimed in claim 1 wherein at least one layer of said element contains 1-formyl-2-(4-[2-(2,4-di-tert-pentylphenoxy)-butyramido]-phenyl)hydrazine.

16. A photographic element as claimed in claim 1 wherein at least one layer of said element contains a hydrazine compound having one of the following structural formulae:

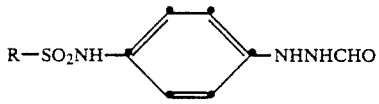

or

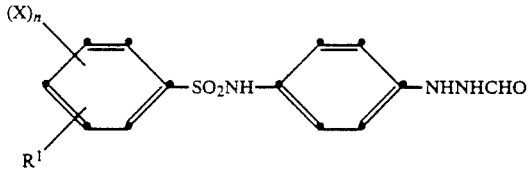

wherein;

R is alkyl having from 6 to about 18 carbon atoms or a heterocyclic ring having 5 or 6 ring atoms, including ring atoms of sulfur or oxygen;

$R^1$ is alkyl or alkoxy having from 1 to about 12 carbon atoms;

X is alkyl, thioalkyl or alkoxy having from 1 to about 5 carbon atoms; halogen; or $—NHCOR^2$, $—NHSO_2R^2$, $—CONR^2R^3$ or $—SO_2R^2R^3$ where $R^2$ and $R^3$, which can be the same or different, are hydrogen or alkyl having from 1 to about 4 carbon atoms; and n is 0,1 or 2.

17. A photographic element as claimed in claim 1 wherein at least one layer of said element contains a hydrazine compound of the formula:

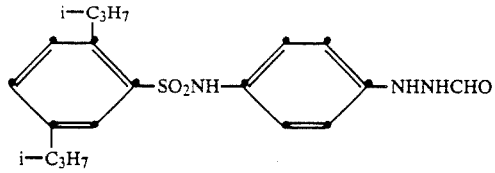

18. A photographic element as claimed in claim 1 wherein said amino compound is present in said element in an amount of from about 1 to about 25 millimoles per mole of silver.

19. A process for forming a high contrast photographic image which comprises developing a photographic element, in the presence of a hydrazine compound, with an aqueous alkaline photographic developing solution; said element including at least one layer comprising, in an amount effective to act as an incorporated booster, an amino compound which (1) comprises at least one secondary or tertiary amino group, (2) contains within its structure a group comprised of at least three repeating ethyleneoxy units, and (3) has a partition coefficient of at least one.

20. A process as claimed in claim 19 wherein said group comprised of at least three repeating ethyleneoxy units is directly linked to a tertiary amino nitrogen atom.

21. A process as claimed in claim 19 wherein said group comprised of at least three repeating ethyleneoxy units is a linking group joining tertiary amino nitrogen atoms of a bis-tertiary amino compound.

22. A process as claimed in claim 19 wherein said amino compound has a partition coefficient of at least three.

23. A process as claimed in claim 19 wherein said amino compound has a partition coefficient of at least four.

24. A process as claimed in claim 19 wherein said amino compound comprises at least 20 carbon atoms.

25. A process as claimed in claim 19 wherein said amino compound is a bis-tertiary amine of the formula:

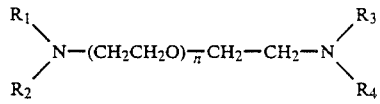

wherein n is an integer with a value of 3 to 50, $R_1$, $R_2$, $R_3$ and $R_4$ are independently alkyl groups of 1 to 8 carbon atoms, $R_1$ and $R_2$ taken together and $R_3$ and $R_4$ taken together represent the atoms necessary to complete a heterocyclic ring.

26. A process as claimed in claim 25 wherein n is an integer with a value of 10 to 50.

27. A process as claimed in claim 19 wherein said amino compound is a bis-secondary amine of the formula:

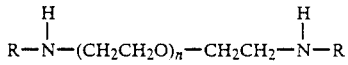

wherein n is an integer with a value of 3 to 50 and each R is, independently, a linear or branched, substituted or unsubstituted alkyl group of at least 4 carbon atoms.

28. A process as claimed in claim 19 wherein said amino compound has the formula:

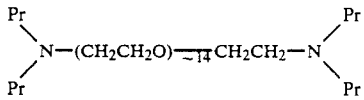

29. A process as claimed in claim 19 wherein said amino compound has the formula:

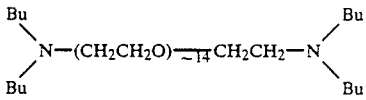

30. A process as claimed in claim 19 wherein said amino compound has the formula:

$$Me—(CH_2)_4NH—(CH_2CH_2O)_{\sim 14}CH_2CH_2NH(CH_2)_4—Me$$

31. A process as claimed in claim 19 wherein at least one layer of said element contains a hydrazine compound.

32. A process as claimed in claim 19 wherein at least one layer of said element contains a hydrazine compound of the formula:

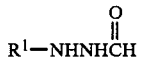

wherein $R^1$ is a phenyl nucleus having a Hammett sigma value-derived electron withdrawing characteristic of less than +0.30.

33. A process as claimed in claim 19 wherein at least one layer of said element contains 1-formyl-2-(4-[2-(2,4-di-tert-pentylphenoxy)-butyramido]phenyl)hydrazine.

34. A process as claimed in claim 19 wherein at least one layer of said element contains a hydrazine compound having one of the following structural formulae:

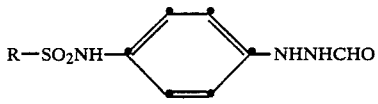

or

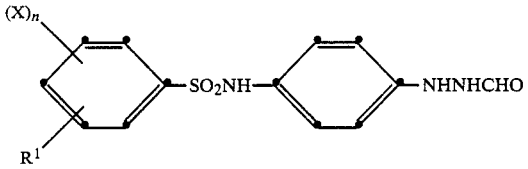

wherein;

R is alkyl having from 6 to about 18 carbon atoms or a heterocyclic ring having 5 or 6 ring atoms, including ring atoms of sulfur or oxygen;

$R^1$ is alkyl or alkoxy having from 1 to about 12 carbon atoms;

X is alkyl, thioalkyl or alkoxy having from 1 to about 5 carbon atoms; halogen; or $—NHCOR^2$, $—NHSO_2R^2$, $—CONR^2R^3$ or $—SO_2R^2R^3$ where $R^2$ and $R^3$, which can be the same or different, are hydrogen or alkyl having from 1 to about 4 carbon atoms; and n is 0,1 or 2.

35. A process as claimed in claim 19 wherein at least one layer of said element contains a hydrazine compound of the formula:

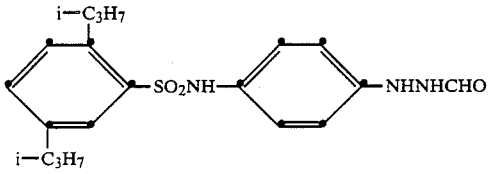

36. A process as claimed in claim 19 wherein said amino compound is present in said element in an amount of from about 1 to about 25 millimoles per mole of silver.

37. A process as claimed in claim 19 wherein said developing solution has a pH in the range of from about 9 to about 12.3.

38. A process as claimed in claim 19 wherein said developing solution comprises a dihydroxybenzene developing agent.

39. A process as claimed in claim 19 wherein said developing solution comprises a dihydroxybenzene developing agent and an auxiliary super additive developing agent.

40. A process as claimed in claim 19 wherein said developing solution comprises hydroquinone and a 3-pyrazolidone developing agent.

41. A process as claimed in claim 19 wherein said developing solution contains a sulfite preservative.

42. A process as claimed in claim 19 wherein said developing solution contains a benzotriazole antifoggant.

43. A process for forming a high contrast photographic image which comprises developing a photographic element with an aqueous alkaline photographic developing solution; said developing solution containing a dihydroxybenzene developing agent, an auxiliary super-additive developing agent and a sulfite preservative; said element containing both a hydrazine compound which functions as a nucleating agent and an amino compound which functions as a booster, said amino compound (1) comprising at least one secondary or tertiary amino group, (2) containing within its structure a group comprised of at least three repeating ethyleneoxy units, and (3) having a partition coefficient of at least three.

44. A process for forming a high contrast photographic image which comprises developing a photographic element with an aqueous alkaline photographic developing solution having a pH in the range of 9 to 10.8, said developing solution containing hydroquinone, a 3-pyrazolidone developing agent and a sulfite preservative; said element containing both a hydrazine compound which functions as a nucleating agent and an amino compound which functions as a booster, said amino compound (1) comprising at least one secondary or tertiary amino group, (2) containing within its structure a group comprised of at least three repeating ethyleneoxy units, and (3) having a partition coefficient of at least three.

45. A silver halide photographic element adapted to form a high contrast image when development is carried out, in the presence of a hydrazine compound, with an aqueous alkaline developing solution, said element including at least one layer comprising, in an amount effective to act as an incorporated booster, an amino compound which (1) comprises at least two secondary or tertiary amino groups, (2) contains within its structure a group comprised of at least three repeating ethyleneoxy units, and (3) has a partition coefficient of at least one.

46. A silver halide photographic element adapted to form a high contrast image when development is carried out, in the presence of a hydrazine compound, with an aqueous alkaline developing solution, containing a dihydroxybenzene developing agent and an auxiliary super-additive developing agent, said element including at least one layer comprising, in an amount effective to act as an incorporated booster, an amino compound which (1) comprises at least one secondary or tertiary amino group, (2) contains within its structure a group comprised of at least three repeating ethyleneoxy units, and (3) has a partition coefficient of at least one.

47. A process for forming a high contrast photographic image which comprises developing a photographic element, in the presence of a hydrazine compound, with an aqueous alkaline photographic developing solution; said element including at least one layer comprising, in an amount effective to act as an incorporated booster, an amino compound which (1) comprises at least two secondary or tertiary amino groups, (2) contains within its structure a group comprised of at least three repeating ethyleneoxy units, and (3) has a partition coefficient of at least one.

48. A process for forming a high contrast photographic image which comprises developing a photographic element, in the presence of a hydrazine compound, with an aqueous alkaline photographic developing solution, containing a dihydroxybenzene developing agent and an auxiliary super-additive developing agent; said element including at least one layer comprising, in an amount effective to act as an incorporated booster, an amino compound which (1) comprises at least one secondary or tertiary amino group, (2) contains within its structure a group comprised of at least three repeating ethyleneoxy units, and (3) has a partition coefficient of at least one.

49. In a silver halide photographic element adapted to form a high contrast image when development is carried out with an aqueous alkaline developing solution containing a dihydroxybenzene developing agent and an auxiliary super-additive developing agent, at least one layer of said element containing a hydrazine compound that functions as a nucleating agent and at least one layer of said element comprising an incorporated booster that functions in concert with said hydrazine compound to provide high contrast, the improvement wherein said incorporated booster is an amino compound which (1) comprises at least one secondary or tertiary amino group, (2) contains within its structure a group comprised of at least three repeating ethyleneoxy units, and (3) has a partition coefficient of at least one.

* * * * *